US010824096B2

(12) United States Patent
Tokoro et al.

(10) Patent No.: US 10,824,096 B2
(45) Date of Patent: Nov. 3, 2020

(54) IMAGE FORMING APPARATUS THAT FORMS IMAGE ON RECORDING PAPER

(71) Applicant: KYOCERA Document Solutions Inc., Osaka (JP)

(72) Inventors: Yoshitaka Tokoro, Osaka (JP); Tetsuya Toichi, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 16/800,535

(22) Filed: Feb. 25, 2020

(65) Prior Publication Data

US 2020/0301320 A1 Sep. 24, 2020

(30) Foreign Application Priority Data

Mar. 19, 2019 (JP) ..... 2019-050774

(51) Int. Cl.
*G03G 15/16* (2006.01)
*G03G 21/00* (2006.01)
*G03G 15/02* (2006.01)

(52) U.S. Cl.
CPC ..... *G03G 15/1615* (2013.01); *G03G 15/0216* (2013.01); *G03G 2215/0016* (2013.01)

(58) Field of Classification Search
CPC ..... G03G 15/0216; G03G 15/1615; G03G 2215/0016
See application file for complete search history.

(56) References Cited

U.S. PATENT DOCUMENTS

2007/0059027 A1* 3/2007 Ishikawa ..... G03G 15/161 399/101
2011/0110693 A1* 5/2011 Hayashi ..... G03G 21/0035 399/349
2016/0062276 A1* 3/2016 Fujimoto ..... G03G 21/0064 399/71

FOREIGN PATENT DOCUMENTS

JP 2018-180102 A 11/2018

* cited by examiner

*Primary Examiner* — Clayton E. LaBalle
*Assistant Examiner* — Michael A Harrison
(74) *Attorney, Agent, or Firm* — IP Business Solutions, LLC

(57) ABSTRACT

An image forming apparatus includes an intermediate transfer belt, an image forming device, a brush roller, a bias application device, and a controller. The bias application device applies, between the intermediate transfer belt and the brush roller, a bias for shifting a charged residual toner from the intermediate transfer belt to the brush roller. The controller controls, in a period in which calibration or maintenance is executed, the bias application device to set an application amount of the bias at a predefined first value only in a specified time zone in which the residual toner is present on the intermediate transfer belt and to set the application amount of the bias at a predefined second value smaller than the first value in time zones other than the specified time zone.

5 Claims, 11 Drawing Sheets

Fig.10

| CALIBRATION OR MAINTENANCE PERIOD | EMBODIMENT | COMPARATIVE EXAMPLE |
|---|---|---|
| DEVELOPMENT CALIBRATION PERIOD ΔTA (195 SECONDS) | 60 μA IN FINAL AGING TIME ZONE ΔTA3 AND 15 μA IN OTHER TIME ZONES | 60 μA THROUGHOUT ENTIRE PERIOD |
| DRUM REFRESH PERIOD ΔTB (60 SECONDS) | 60 μA IN FINAL AGING TIME ZONE ΔTB3 AND 15 μA IN OTHER TIME ZONES | 60 μA THROUGHOUT ENTIRE PERIOD |
| DEVELOPMENT REFRESH PERIOD ΔTC (90 SECONDS) | 60 μA IN FINAL AGING TIME ZONE ΔTC4 AND 15 μA IN OTHER TIME ZONES | 60 μA THROUGHOUT ENTIRE PERIOD |
| FULL CALIBRATION AND T/C CORRECTION PERIOD ΔTD (80 SECONDS) | 60 μA IN FULL CALIBRATION TIME ZONE (20 SECONDS) AND 15 μA IN T/C CORRECTION TIME ZONE (60 SECONDS) | 60 μA THROUGHOUT ENTIRE PERIOD |

Fig.11A

BIAS BI OF EMBODIMENT (15 μA, 60 μA)

UNIT #:0633

| NUMBER OF TIMES OF EXPERIMENTS | RUNS ONTO OR NOT | DISTANCE (mm) |
|---|---|---|
| FIRST TIME | NO | 10 |
| SECOND TIME | NO | 10 |
| THIRD TIME | NO | 10 |

UNIT #:1794

| NUMBER OF TIMES OF EXPERIMENTS | RUNS ONTO OR NOT | DISTANCE (mm) |
|---|---|---|
| FIRST TIME | NO | 10 |
| SECOND TIME | NO | 9.8 |
| THIRD TIME | NO | 10 |

UNIT #:1218

| NUMBER OF TIMES OF EXPERIMENTS | RUNS ONTO OR NOT | DISTANCE (mm) |
|---|---|---|
| FIRST TIME | NO | 10 |
| SECOND TIME | NO | 10 |
| THIRD TIME | NO | 9.9 |

Fig.11B

BIAS BI OF COMPARATIVE EXAMPLE (60 μA)

UNIT #:0633

| NUMBER OF TIMES OF EXPERIMENTS | RUNS ONTO OR NOT | DISTANCE (mm) |
|---|---|---|
| FIRST TIME | YES | 11 |
| SECOND TIME | YES | 11 |
| THIRD TIME | YES | 11 |

UNIT #:1794

| NUMBER OF TIMES OF EXPERIMENTS | RUNS ONTO OR NOT | DISTANCE (mm) |
|---|---|---|
| FIRST TIME | YES | 11 |
| SECOND TIME | YES | 11 |
| THIRD TIME | YES | 11 |

UNIT #:1218

| NUMBER OF TIMES OF EXPERIMENTS | RUNS ONTO OR NOT | DISTANCE (mm) |
|---|---|---|
| FIRST TIME | YES | 11 |
| SECOND TIME | YES | 11 |
| THIRD TIME | YES | 11 |

IMAGE FORMING APPARATUS THAT FORMS IMAGE ON RECORDING PAPER

INCORPORATION BY REFERENCE

This application claims priority to Japanese Patent Application No. 2019-050774 filed on Mar. 19, 2019, the entire contents of which are incorporated by reference herein.

BACKGROUND

This disclosure relates to an image forming apparatus such as a multifunction peripheral or a printer, and more specifically to a technology for suppressing deviation of an intermediate transfer belt.

In an image forming apparatus, a toner image is formed on a surface of an image carrier (photoconductive drum), an intermediate transfer belt of an endless type stretched over a plurality of rollers are caused to make circular movement while being pressed against the image carrier whereby the toner image is primarily transferred from the image carrier onto the intermediate transfer belt and the toner image is further secondarily transferred from the intermediate transfer belt onto recording paper. Moreover, with a fur brush roller pressed against the intermediate transfer belt, a bias is applied to the fur brush roller to remove the charged residual toner on the intermediate transfer belt by the fur brush roller. A bias for shifting the residual toner from the intermediate transfer belt to the fur brush roller is applied between the intermediate transfer belt and the fur brush roller.

SUMMARY

As one aspect of this disclosure, a technology obtained by further improving the technology described above will be suggested.

An image forming apparatus according to one aspect of this disclosure includes: an intermediate transfer belt, an image forming device, a brush roller, a bias application device, and a control device. The intermediate transfer belt is of an endless type being stretched over a plurality of rollers, circularly moved, and carrying a toner image to be transferred to recording paper. The image forming device forms the toner image and transfers the toner image to the intermediate transfer belt. The brush roller makes contact with the intermediate transfer belt and removes a charged residual toner carried on the intermediate transfer belt. The bias application device applies, between the intermediate transfer belt and the brush roller, a bias for shifting the charged residual toner from the intermediate transfer belt to the brush roller. The control device includes a processor and, as a result of executing a control program by the processor, functions as a controller. The controller controls, in a period in which calibration or maintenance is executed, the bias application device to set an application amount of the bias at a predefined first value only in a specified time zone in which the residual toner is present on the intermediate transfer belt and to set the application amount of the bias at a predefined second value smaller than the first value in time zones other than the specified time zone.

BRIEF DESCRIPTION OF THE DRAWINGS

FIG. 10 is a table illustrating a bias applied between the intermediate transfer belt and fur brush roller and application time in this embodiment and a bias and application time of the comparative example for each of development calibration, drum refresh, development refresh, and full calibration in an organized manner.

FIG. 11A shows tables illustrating results of experiments in which distances corresponding to deviation of the intermediate transfer belt and whether or not the intermediate transfer belt runs onto a convex part formed on a roller are examined, in a case where three sets of intermediate transfer units having same structures are prepared and application amounts and application time of the bias are set as in this embodiment.

FIG. 11B shows tables illustrating results of experiments in which the distance corresponding to the deviation of the intermediate transfer belt and whether or not the intermediate transfer belt runs onto the convex part formed on the roller are examined, in a case where the application amounts and application time of the bias are set as described in the comparative example.

DETAILED DESCRIPTION

Hereinafter, an image forming apparatus according to an embodiment of this disclosure will be described with reference to the drawings.

Figure 1:
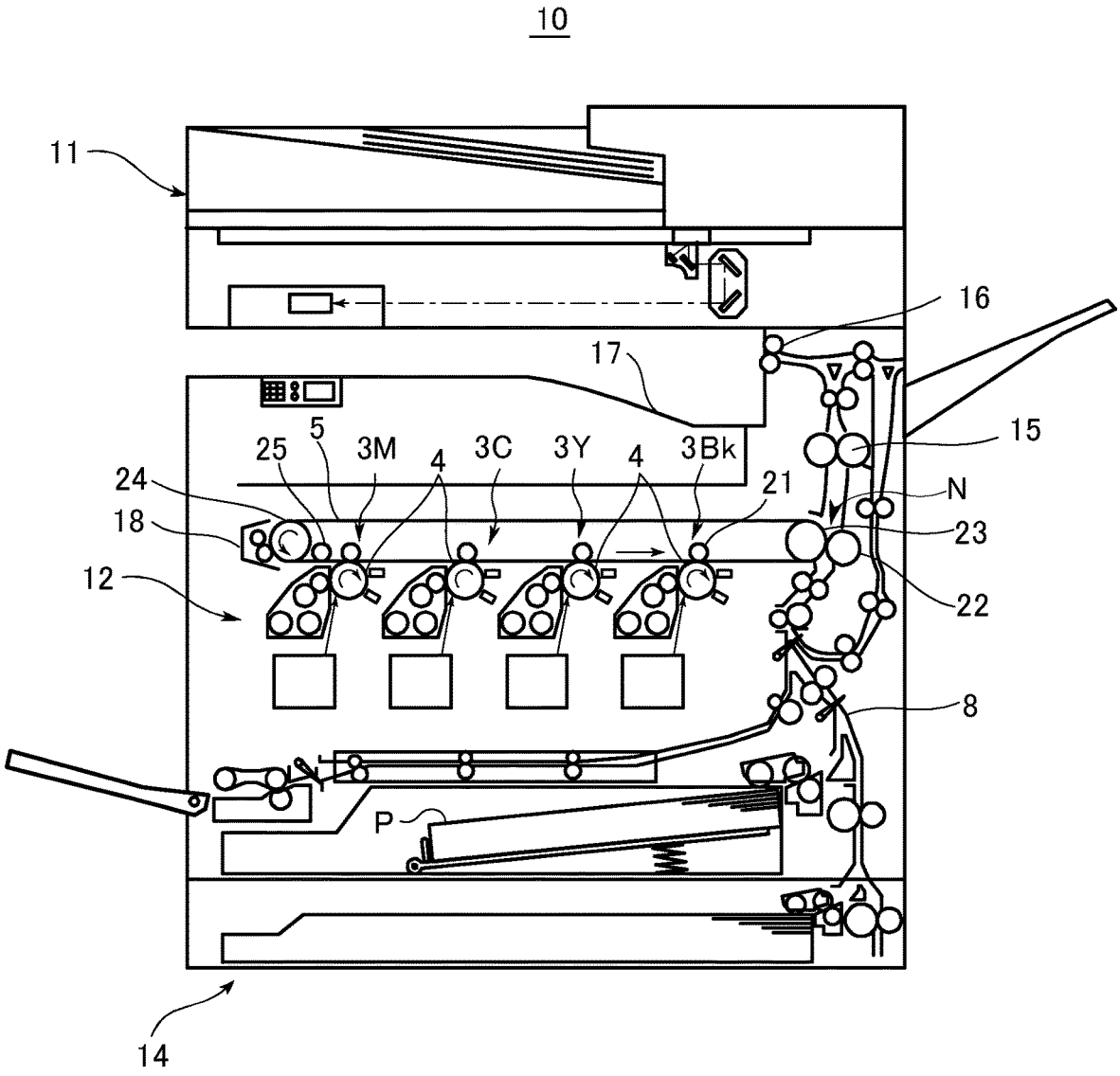
FIG. 1 is a sectional view illustrating an image forming apparatus according to one embodiment of this disclosure.

FIG. 1 is a sectional view illustrating the image forming apparatus according to one embodiment of this disclosure. An image forming apparatus 10 is a multifunction peripheral (MFP) combining together a plurality of functions such as, for example, a copy function, a printer function, and a facsimile function. The image forming apparatus 10 includes an image reading device 11 and an image forming device 12.

The image reading device 11 has an image pickup element which optically reads an image of a document. Analog output of the image pickup element is converted into a digital signal whereby image data indicating the image of the document is generated.

The image forming device 12 includes a photoconductive drum, a developing member, a drum cleaner, a charger, etc. for each color. The image forming device 12 forms, on recording paper, an image indicated by the image data, and includes a magenta image forming unit 3M, a cyan image forming unit 3C, a yellow image forming unit 3Y, and a black image forming unit 3Bk. In any one of the image forming units 3M, 3C, 3Y, and 3Bk, a surface of the photoconductive drum 4 is uniformly charged and then exposed to form an electrostatic latent image on the surface of the photoconductive drum 4, and the electrostatic latent image on the surface of the photoconductive drum 4 is developed into a toner image.

The intermediate transfer belt 5 is an endless belt and is stretched over a plurality of rollers including a drive roller 23, a tension roller 24, and a backup roller 25, so that the intermediate transfer belt 5 is driven by the drive roller 23 to make circular movement. Upon the circular movement of the intermediate transfer belt 5, the toner images on the surfaces of the respective photoconductive drums 4 are primarily transferred by respective primary transfer rollers 21 and superposed on each other on the surface of the intermediate transfer belt 5, thereby forming a color toner image formed on the surface of the intermediate transfer belt 5. The color toner image formed on the surface of the intermediate transfer belt 5 is secondarily transferred onto recording paper P from a communication section 14 through a conveyance path 8 at a nip part N between a secondary transfer roller 22 and the drive roller 23. A belt cleaner 18 includes a fur brush roller 19 (FIGS. 2 to 4), by which the charged residual toner on the intermediate transfer belt 5 is removed.

Subsequently, the recording paper P is heated and pressurized at a fixing part 15 whereby the toner image on the recording paper P is fixed through thermal compression and the recording paper P is further discharged onto a discharge tray 17 through a discharge roller 16.

Next, an intermediate transfer unit 20 including the intermediate transfer belt 5, the primary transfer rollers 21, the drive roller 23, the tension roller 24, the backup roller 25, and the belt cleaner 18 will be described in detail.

Figure 2:
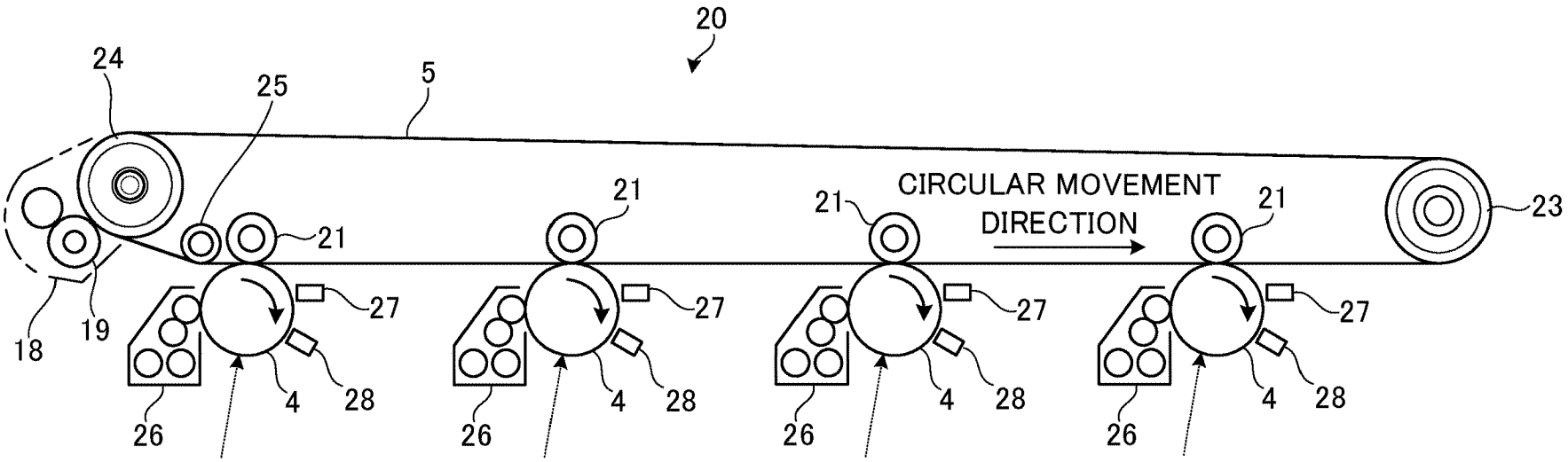
FIG. 2 is a side view illustrating an intermediate transfer unit, etc. in the image forming apparatus of this embodiment.
Figure 3:
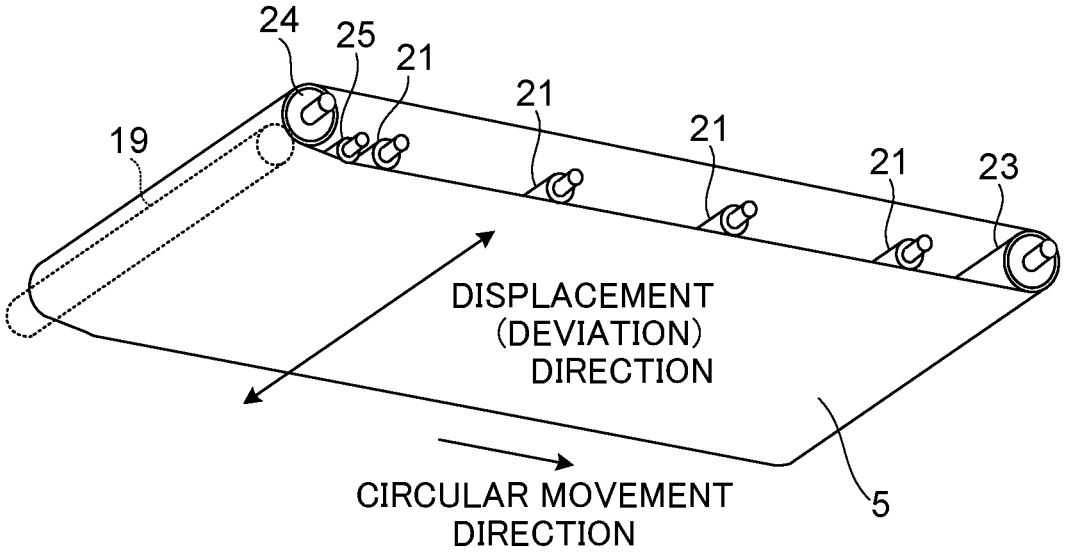
FIG. 3 is a perspective view schematically illustrating an intermediate transfer belt, etc. in the intermediate transfer unit viewed from a bottom.
Figure 4:
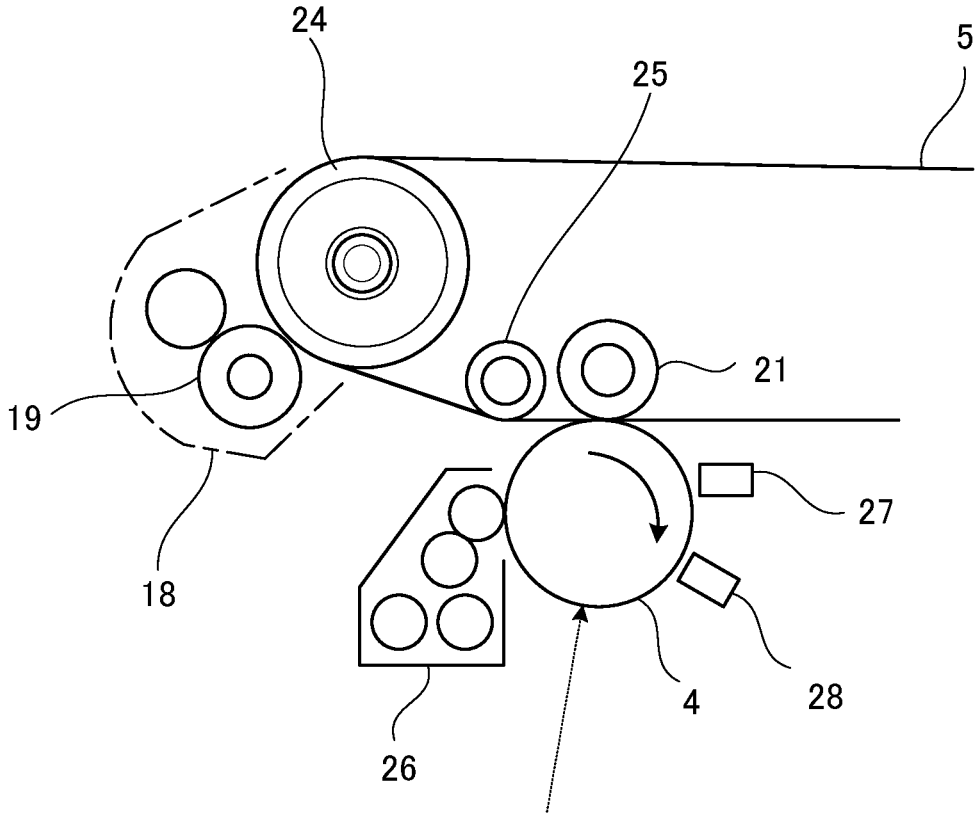
FIG. 4 illustrates a side surface illustrating a tension roller, a backup roller, etc. of the intermediate transfer unit on an enlarged scale.

FIG. 2 is a side view illustrating the intermediate transfer unit 20, etc. FIG. 3 is a perspective view schematically illustrating the intermediate transfer belt 5, etc. of the intermediate transfer unit 20 from a bottom. FIG. 4 is a side view illustrating the primary transfer rollers 21, the tension roller 24, the belt cleaner 18, etc. of the intermediate transfer unit 20 on an enlarged scale.

As illustrated in FIGS. 2 to 4, in the intermediate transfer unit 20, the primary transfer rollers 21, the drive roller 23, the tension roller 24, and the backup rollers 25 are provided, the intermediate transfer belt 5 is stretched over these rollers 21, 23, 24, and 25, and the primary transfer rollers 21 are pressed against the respective photoconductive drums 4 through the intermediate transfer belt 5. The fur brush roller 19 of the belt cleaner 18 is in contact with a portion of the intermediate transfer belt 5 curved along the tension roller 24.

Moreover, a developing part 26, a drum cleaner 27, a charger 28, etc. are provided at a bottom of the intermediate transfer unit 20 for each of the photoconductive drums 4. Each photoconductive drum 4 is rotationally driven in an arrow direction following the rotation of the photoconductive drum 4. The surface of the photoconductive drum 4 is uniformly charged by the charger 28 and the surface of the photoconductive drum 4 is exposed by an exposure apparatus (not illustrated), forming an electrostatic latent image on the surface of the photoconductive drum 4. Then the electrostatic latent image formed on the surface of the photoconductive drum 4 is developed into a toner image by the developing part 26 and the toner image formed on the surface of the photoconductive drum 4 is primarily transferred onto the intermediate transfer belt 5 by the primary transfer roller 21. Then the surface of the photoconductive drum 4 is discharged and the residual toner on the surface of the photoconductive drum 4 is removed by the drum cleaner 27.

Then a color toner image on which the toner images on the surfaces of the respective photoconductive drums 4 are superposed on each other is formed on the intermediate transfer belt 5, the color toner image is secondarily transferred from the intermediate transfer belt 5 onto the recording paper P at the nip part N (illustrated in FIG. 1) between a secondary transfer roller 22 and the drive roller 23, and the charged residual toner on the intermediate transfer belt 5 is removed by the fur brush roller 19 of the belt cleaner 18.

Figure 5:
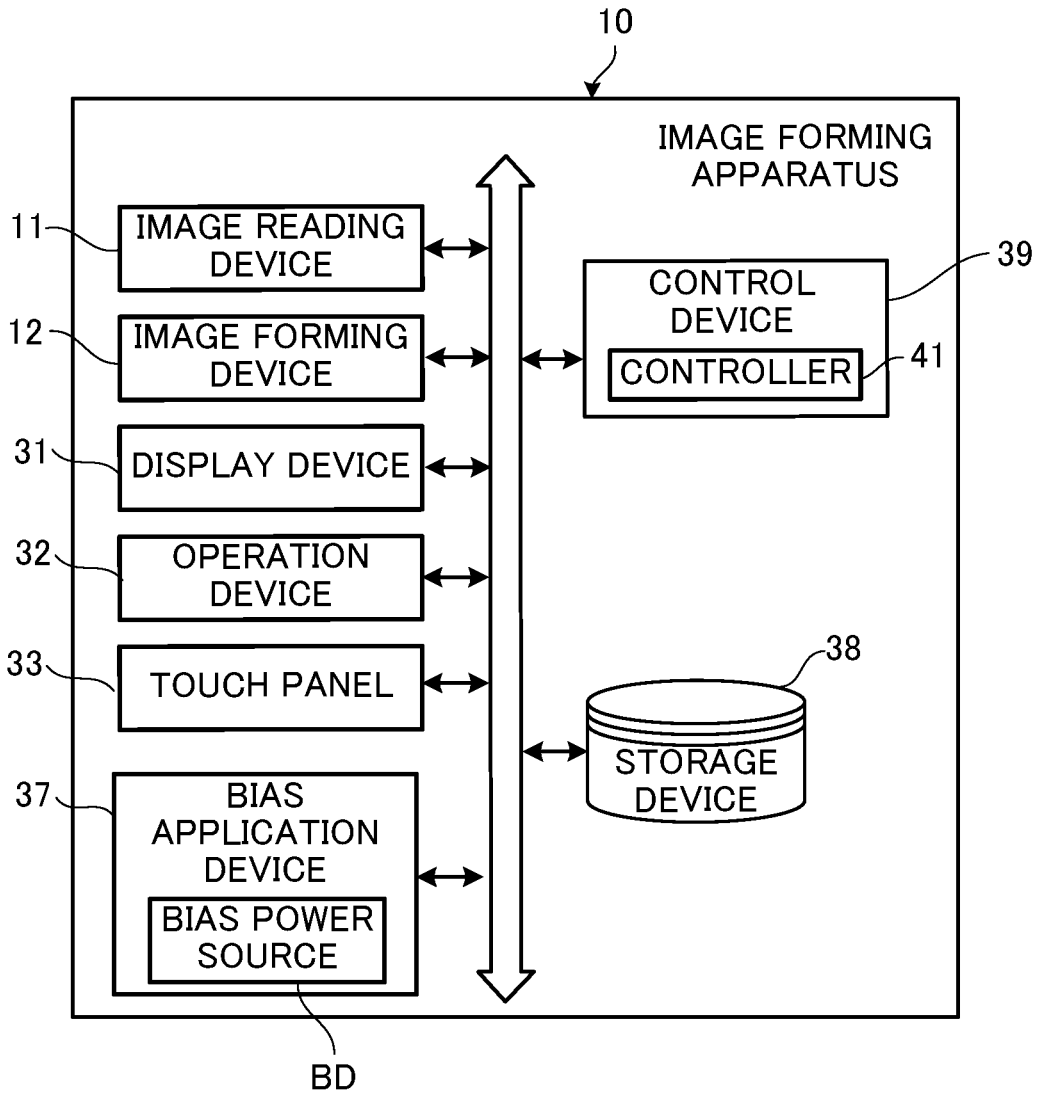
FIG. 5 is a block diagram illustrating main inner configuration of the image forming apparatus.

Next, FIG. 5 is a block diagram illustrating main inner configuration of the image forming apparatus 10 of this embodiment. As illustrated in FIG. 5, the image forming apparatus 10 of this embodiment includes: an image reading device 11, an image forming device 12, a display device 31, an operation device 32, a touch panel 33, a bias application device 37, a storage device 38, and a control device 39. The aforementioned components are capable of performing data or signal transmission and reception to and from each other through a bus.

The display device 31 is a display apparatus such as a liquid crystal display (LCD) or an organic light-emitting diode (OLED) display.

The operation device 32 includes physical keys such as ten keys, a determine key, and a start key.

The touch panel 33 is arranged on a screen of the display device 31. The touch panel 33 is a touch panel of a so-called resistive film type or an electrostatic capacitive type. The touch panel 33 detects touch of a user's finger or the like on the touch panel 33 together with a position of the aforementioned touch and outputs a detection signal indicating coordinates of the touch position to, for example, a controller 41 to be described later on, of the control device 39. The touch panel 33 plays a role as an operation device, together with the operation device 32, to which user operation performed on the screen of the display device 31 is inputted.

The bias application device 37 is a power supply apparatus including a bias power source which supplies a bias current to the fur brush roller 19 and applies a bias to the fur brush roller 19 of the belt cleaner 18. The bias application device 37 includes, as this bias power source, a bias power source BD which applies a bias BI between the intermediate transfer belt 5 and the fur brush roller 19.

The storage device 38 is a large-capacity storage device such as a solid-state drive (SSD) or a hard disc drive (HDD) and stores various types of application programs and various pieces of data.

The control device 39 is composed of: a processor, a random access memory (RAM), a read only memory (ROM), etc. The processor is, for example, a central processing unit (CPU), an application specific integrated circuit (ASIC), or a micro processing unit (MPU). The control device 39 functions as the controller 41 as a result of executing a control program stored in the ROM or the storage device 38 by the processor.

The controller 41 performs overall control of the image forming apparatus 10. The control device 39 is connected to the image reading device 11, the image forming device 12, the display device 31, the operation device 32, the touch panel 33, the bias application device 37, the storage device 38, etc. The controller 41 performs operation control of these components and signal or data transmission and reception between the components.

The controller 41 plays a role as a processor which executes, for example, various types of processing required for image formation performed by the image forming apparatus 10. Moreover, the controller 41 has a function of controlling display operation of the display device 31 and a function of controlling each bias power source in the bias application device 37.

Here, for the purpose of executing various types of calibration or maintenance, the controller 41 controls each bias power source in the bias application device 37 upon every calibration or maintenance in the image forming apparatus 10 with the aforementioned configuration. The controller 41 adjusts biases applied to the photoconductive drums 4, the intermediate transfer belt 5, a developing roller of the developing part 26, the fur brush roller 19 of the belt cleaner 18, etc.

On the other hand, the inventors of this application have found that the intermediate transfer belt 5 is displaced in a direction orthogonal to a circular rotation direction of the intermediate transfer belt 5 (a longitudinal direction of the plurality of rollers described above and a width direction of the intermediate transfer belt 5 while stretched over the plurality of rollers) corresponding to an amount of the bias BI applied between the intermediate transfer belt 5 and the fur brush roller 19 of the belt cleaner 18, that is, the intermediate transfer belt 5 is offset from a regular position in the aforementioned direction on circumferential surfaces of the plurality of rollers described above, thereby causing deviation. It is preferable that the intermediate transfer belt 5 be always circularly moved at the regular position without any deviation, and thus it is required to suppress the deviation corresponding to the amount of such a bias BI applied.

Thus, in the image forming apparatus 10 of this embodiment, the controller 41 controls the bias power source BD in the bias application device 37 in a calibration or maintenance period to set, at a predefined first value, the amount of the bias BI applied between the intermediate transfer belt 5 and the fur brush roller 19 only in a specified time zone in which the residual toner is present on the intermediate transfer belt 5 and to set, at a predefined second value smaller than the first value, the amount of the bias BI applied in other time zones other than the aforementioned specified time zone. Since the residual toner on the intermediate transfer belt 5 is charged, setting the amount of the bias BI at a large value as the first value in the specified time zone favorably removes the residual toner on the intermediate transfer belt 5 by the fur brush roller 19. Moreover, since the amount of the bias BI applied in the time zones other than the specified time zone is set at a small value as the second value, the deviation of the intermediate transfer belt 5 is suppressed. That is, the first value is a predefined bias value with which the residual toner on the intermediate transfer belt 5 can be favorably removed by the fur brush roller 19.

Note that the residual toner on the intermediate transfer belt 5 is little during normal operation in which an image is recorded onto recording paper, so that the amount of the bias BI applied does not have to be increased and may be, for example, an amount of bias applied including a value at the same level as that of the second value described above.

Next, adjustment of the bias BI between the intermediate transfer belt 5 and the fur brush roller 19 will be described, referring to development calibration, drum refresh, development refresh, and full calibration as examples.

<Development Calibration>

Upon executing the development calibration, the controller 41 controls the developing parts 26 for the respective colors to form toner images on the surfaces of the photoconductive drums 4 by the developing parts 26. The toner images of the respective colors are transferred from the respective photoconductive drums 4 to the intermediate transfer belt 5. At time of this development calibration, charged residual toners of the respective colors on the intermediate transfer belt 5 need to be removed by the fur brush roller 19 of the belt cleaner 18. Thus, the controller 41 causes the bias power source BD in the bias application device 37 to supply a bias current to the fur brush roller 19, causing the bias BI to be applied between the intermediate transfer belt 5 and the fur brush roller 19 of the belt cleaner 18.

At this point, it is preferable that the amount of the bias BI applied be set at a value sufficient for moving the residual toner from the intermediate transfer belt 5 to the fur brush roller 19. However, the intermediate transfer belt 5 is displaced in the direction orthogonal to the circular rotation direction thereof (width direction of the intermediate transfer belt 5) by the application of the bias BI between the intermediate transfer belt 5 and the fur brush roller 19 as described above. Therefore, continuously maintaining the application amount of the bias at the sufficient value described above throughout the entire development calibration period increases the deviation of the intermediate transfer belt 5.

Figure 6:
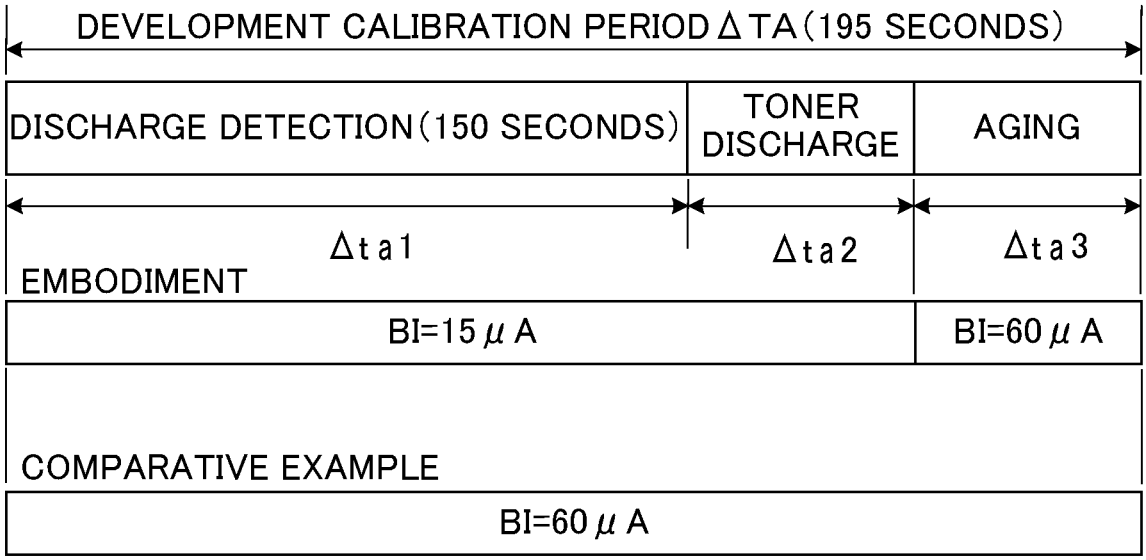
FIG. 6 is a diagram illustrating transition of a bias applied between the intermediate transfer belt and a fur brush roller in this embodiment and a bias of a comparative example during a development calibration period including a discharge adjustment time zone, a toner discharge time zone, and an aging time zone.

Thus, as illustrated in FIG. 6, assuming that, in the development calibration period ΔTA, a time zone in which AC and DC biases applied as developing biases between the developing roller and the supply roller are adjusted to such an extent that does not cause discharge is a discharge adjustment time zone Δta1, a time zone in which the toner images of the respective colors are formed and transferred from the respective photoconductive drums 4 to the intermediate transfer belt 5 is a toner discharge time zone Δta2, and a time zone for stabilizing the operation of the developing parts 26 is an aging time zone Δta3, the controller 41 sets, at as large as 60 μA as the first value, the bias BI applied between the intermediate transfer belt 5 and the fur brush roller 19 only in the final aging time zone Δta3 and sets the bias BI at as small as 15 μA as the second value in the discharge adjustment time zone Δta1 and the toner discharge time zone Δta2. The discharge adjustment time zone Δta1 is a period of a preset specified length, for example, 150 seconds. The toner discharge time zone Δta2 is, for example, a fixed time zone in accordance with a predefined distance of the circular movement of the intermediate transfer belt 5 from a time point at which the discharge adjustment time zone Δta1 ends. The aging time zone Δta3 is a fixed time zone in which the intermediate transfer belt 5 makes, for example, two circular movements from a time point at which the toner discharge time zone Δta2 ends.

In this case, the controller 41 executes the development calibration and counts passage time from a time point at which the toner discharge time zone Δta2 starts and at the same time controls the bias power source BD in the bias application device 37 to set, based on the aforementioned passage time, the bias BI at as relatively small as 15 μA in the discharge adjustment time zone Δta1 and the toner discharge time zone Δta2 and set the bias BI at as large as 60 μA only in the aging time zone Δta3 after ending of the transfer of the toners of the respective colors from the respective photoconductive drums 4 to the intermediate transfer belt 5. That is, the aging time zone Δta3 is a time zone in which the residual is on the intermediate transfer belt 5. The development calibration and the bias application are simultaneously performed in the developing parts 26 and the photoconductive drums 4 for the respective colors. Note that "the fixed time zone until the intermediate transfer belt 5 makes two circular movements" described above is a period in which the intermediate transfer belt 5 portion which is located at a nip part between the photoconductive drum 4 and the primary transfer roller 21 and on which the toner image has been transferred returns to the nip part second time after making two circular movements from a time point at which the toner image has been transferred. Note that the same definition of the aging time zone Δta3 also applies to a case where the development calibration and the aforementioned bias application are performed on the developing part 26 and the photoconductive drum 4 of any of the respective colors.

As described above, shortening the time zone in which the bias BI is set at 60 μA in the development calibration period ΔTA makes it possible to suppress the deviation of the intermediate transfer belt 5 while favorably removing the residual toner on the intermediate transfer belt 5. Moreover, the components included in the intermediate transfer unit 20 are more likely to deteriorate with an increase in the bias BI, and thus lengthening the time zone in which the bias BI is set at 15 μA suppresses the component deterioration.

Various types of calibration and maintenance are carried out and the bias applied between the intermediate transfer belt and the fur brush roller is appropriately set on an individual calibration and maintenance basis in the image forming apparatus. Here, the inventors of this application found that the intermediate transfer belt of an endless type is displaced in the direction orthogonal to the circular rotation direction of the intermediate transfer belt (the width direction of the endless intermediate transfer belt stretched over the plurality of rollers and circularly moved) corresponding to the application amount of the bias, that is, the deviation occurs in the intermediate transfer belt on the aforementioned rollers upon attempting to obtain an optimum value of such a bias through, for example, an experiment. Since it is preferable that the intermediate transfer belt be caused to constantly make circular movement at a fixed position without any deviation, a technology has been consequently suggested for suppressing the deviation corresponding to the application amount of such a bias.

On the contrary, it is possible in this embodiment to suppress the deviation of the intermediate transfer belt caused due to the bias applied between the intermediate transfer belt and the fur brush roller for the purpose of moving the residual toner from the intermediate transfer belt to the fur brush roller in a period in which the calibration or maintenance is executed.

On the contrary, the bias BI is set at a relatively large value, i.e., 60 μA throughout the entire development calibration period ΔTA as illustrated in FIG. 6 in a comparative example. Thus, the deviation occurs in the intermediate transfer belt 5 even when the residual toner on the intermediate transfer belt 5 can be favorably removed.

Note that the second value for providing the relatively low bias BI is 15 μA here, but the second value is not limited to the aforementioned value and for example, any other value lower than the first value or 0 μA may be adopted. The same applies to cases of the drum refresh, the development refresh, and the calibration and T/C correction described below.

<Drum Refresh>

Upon executing the drum refresh, the controller 41 controls the image forming device 12 including the developing parts 26, the drum cleaners 27, etc., causing toner layers to be formed on the entire surfaces of the photoconductive drums 4 and causing the toner layers on the surfaces of the photoconductive drums 4 to be removed by the drum cleaners 27 to collect substances adhering to the surfaces of the photoconductive drums 4 together with the toners. Consequently, the surfaces of the photoconductive drums 4 are refreshed.

The toners of the respective colors are transferred from the respective photoconductive drums 4 to the intermediate transfer belt 5 at this point, so that the charged residual toners of the respective colors on the intermediate transfer belt 5 need to be removed by the fur brush roller 19 of the belt cleaner 18. Thus, the controller 41 causes the bias power source BD in the bias application device 37 to supply a bias current to the fur brush roller 19 whereby the bias BI is applied between the intermediate transfer belt 5 and the fur brush roller 19 of the belt cleaner 18.

Upon bias application as described above, as illustrated in FIG. 7, for example, assuming that, in the drum refresh period ΔTB, time zones in which the respective photoconductive drums 4 are charged are charge aging time zones Δtb1, Δtb2, and Δtb3, respectively, and a time zone in which the toners of the respective colors are transferred from the respective photoconductive drums 4 to the intermediate transfer belt 5 is a toner discharge time zone Δtbb, the controller 41 sets the bias BI applied between the intermediate transfer belt 5 and the fur brush roller 19 at as large as 60 μA as the first value only in the final charge aging time zone Δtb3 and sets the bias BI at as small as 15 μA as the second value in the other charge aging time zones Δtb1 and Δtb2 other than the final charge aging time zone Δtb3 and the toner discharge time zones Δtbb. The charge aging time zones Δtb1, Δtb2, and Δtb3 are periods of respective preset lengths and the final charge aging time zone is a fixed time zone in which the intermediate transfer belt 5 makes, for example, nine circular movements. That is, the aging time zone Δta3 is also a time zone in which the residual toner is on the intermediate transfer belt 5. The toner discharge time zone Δtbb is a fixed time zone in accordance with a predefined distance over which the intermediate transfer belt 5 has made circular movement since a time point at which the charge aging period has ended.

In this case, the controller 41 executes the drum refresh, counts time which has passed from a time point at which the charge aging time zone tb1 has started and, at the same time, controls the bias power source BD in the bias application device 37 to, based on the aforementioned passage time, set the bias BI, applied between the intermediate transfer belt 5 and the fur brush roller 19, at as relatively small as 15 μA in the charge aging time zones Δtb1 and Δtb2 and the toner discharge time zones Δtbb and set the bias BI at as relatively large as 60 μA only in the final charge aging time zone Δtb3 after ending of the transfer of the toners of the respective colors from the respective photoconductive drums 4 to the intermediate transfer belt 5.

Therefore, after ending of the transfer of the respective toners from the respective photoconductive drums 4 to the intermediate transfer belt 5 in each toner discharge time zone Δtbb, the residual toners of the respective colors on the intermediate transfer belt 5 are removed by the fur brush roller 19 in the final charge aging time zone Δtb3.

Consequently, the time zone in which the bias BI is set at 60 μA in the drum refresh period ΔTB is shortened, permitting favorable removal of the residual toners on the intermediate transfer belt 5 while suppressing the deviation of the intermediate transfer belt 5. Moreover, lengthening the time zones in which the bias BI is set at 15 μA suppresses component deterioration.

Figure 7:
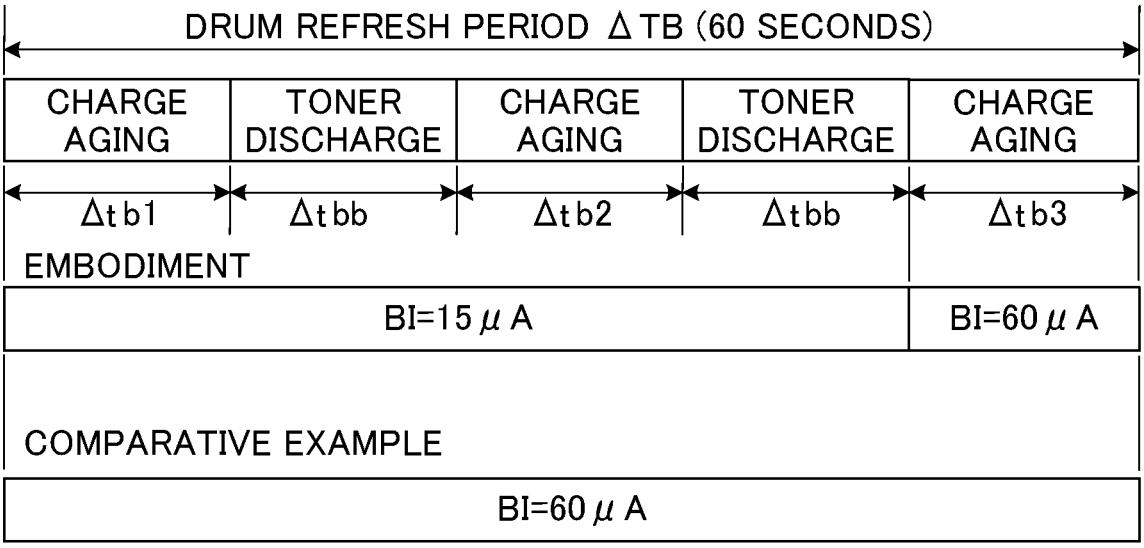
FIG. 7 is a diagram illustrating transition of a bias applied between the intermediate transfer belt and the fur brush roller in this embodiment and a bias of the comparative example during a drum refresh period including a development aging time zone and the toner discharge time zone.

On the contrary, the bias BI is set at 60 μA throughout the drum refresh period ΔTB in the comparative example as illustrated in FIG. 7, so that the deviation of the intermediate transfer belt 5 occurs even when the residual toners on the intermediate transfer belt 5 can be favorably removed.

<Development Refresh>

In the development refresh, the controller 41 controls the image forming device 12 including the developing parts 26, the drum cleaners 27, etc. whereby the degraded toners in the developing parts 26 are discharged to the photoconductive drums 4 and the degraded toners on the surfaces of the photoconductive drums 4 are removed and collected by the drum cleaners 27.

At this point, the toners of the respective colors are transferred from the respective photoconductive drums 4 to the intermediate transfer belt 5, so that the charged residual toners of the respective colors on the intermediate transfer belt 5 need to be removed by the fur brush roller 19 of the belt cleaner 18.

Figure 8:
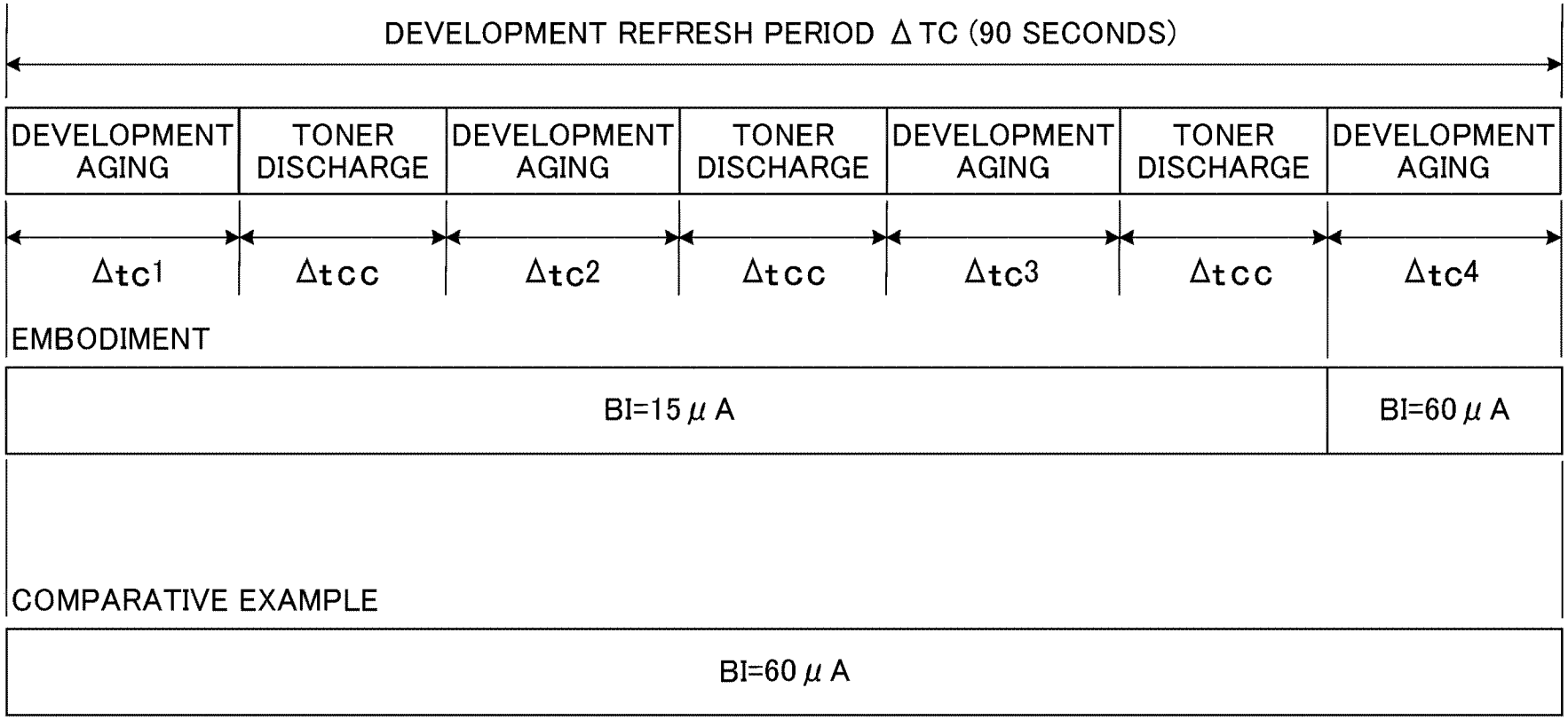
FIG. 8 is a diagram illustrating transition of a bias applied between the intermediate transfer belt and the fur brush roller in this embodiment and a bias of a comparative example during a development refresh period including the development aging time zone and the toner discharge time zone.

Thus, as illustrated in FIG. 8, assuming that, in a development refresh period ΔTC, time zones in which the aging of the developing parts 26 is performed are development aging time zones Δtc1, tc2, tc3, and tc4, respectively, and a time zone in which the toner of the respective colors are transferred from the respective photoconductive drums 4 to the intermediate transfer belt 5 is a toner discharge time zone Δtcc, the controller 41 sets the bias BI, applied between the intermediate transfer belt 5 and the fur brush roller 19, at as large as 60 μA only in the final development aging time zone Δtc4 and sets the bias BI at as small as 15 uA in the other development aging time zones Δtc1 to tc3 other than the final development aging time zone Δtc4 and the toner discharge time zones Δtcc. The development aging time zones Δtc1 to Δtc3 are time zones of respective preset lengths and the final development aging time zone Δtc4 is a fixed time zone in which the intermediate transfer belt 5 makes two revolutions. The toner discharge time zone Δtcc is a fixed time zone in accordance with a predetermined distance over which the intermediate transfer belt 5 has made circular movement since a time point at which the development aging time zone has ended.

In this case, the controller 41 executes the development refresh, and counts time which has passed from a time point at which the development aging time zone Δtc1 started and, at the same time, controls the bias power source BD in the bias application device 37 to, based on the passage time, set the bias BI at as small as 15 μA in the development aging time zones Δtc1 to Δtc3 and the toner discharge time zones Δtcc and set the bias BI at as large as 60 μA only in the final charge aging time zone Δtc4 after the toners of the respective colors are transferred from the respective photoconductive drums 4 to the intermediate transfer belt 5. That is, the final charge aging time zone Δtc4 is also a time zone in which the residual toners are on the intermediate transfer belt 5.

Therefore, after ending of the transfer of all the toners from the respective photoconductive drums 4 to the intermediate transfer belt 5 in each toner discharge time zone Δtcc, the residual toners of the respective colors on the intermediate transfer belt 5 are removed by the fur brush roller 19 in the final charge aging time zone Δtc4.

Consequently, it is possible to shorten the time zone in which the bias BI is set at 60 μA in the development refresh period ΔTC to favorably remove the residual toners on the intermediate transfer belt 5 while suppressing the deviation of the intermediate transfer belt 5. Moreover, lengthening the time zones in which the bias BI is set at 15 μA suppresses the component degradation.

On the contrary, the bias BI is set at 60 μA throughout the development refresh period ΔTC in the comparative example as illustrated in FIG. 8, so that the deviation of the intermediate transfer belt 5 occurs even through the residual toners on the intermediate transfer belt 5 can be favorably removed.

<Full Calibration and T/C Correction>

Upon executing the full calibration, the controller 41 controls the image forming device 12 including the developing parts 26, the exposure apparatuses (not illustrated), etc., causing the toner images to be generated on the surfaces of the photoconductive drums 4, causing the toner images of the test patterns to be transferred to the intermediate transfer belt 5, and causing a sensor (not illustrated) to detect concentration of the toner images of the test patterns on the intermediate transfer belt 5. Then the controller 41 calculates an optimum value of a bias applied between a development roller and a supply roller of the developing part 26 based on the concentration of the toner image of the test pattern detected by the sensor, and controls a bias power source for the developing part 26 in the bias application device 37 to set the bias applied between the aforementioned rollers at the optimum value.

At this point, the toner images of the test patterns of the respective colors are respectively transferred from the photoconductive drums 4 to the intermediate transfer belt 5, so that the changed toner images of the respective colors on the intermediate transfer belt 5 need to be removed by the fur brush roller 19 of the belt cleaner 18.

Moreover, upon executing the T/C correction, the controller 41 causes the sensor (not illustrated) to detect the concentration of the toner stored in the developing part 26 (a ratio of the toner with respect to a carrier, i.e., so-called T/C) and causes the developing part 26 to replenish a toner from a toner container so that the detected concentration of the toner becomes a specified value.

Since no toner is transferred from the photoconductive drums 4 to the intermediate transfer belt 5 upon the execution of the T/C correction, the residual toners on the intermediate transfer belt does not have to be removed by the fur brush roller 19.

Figure 9:
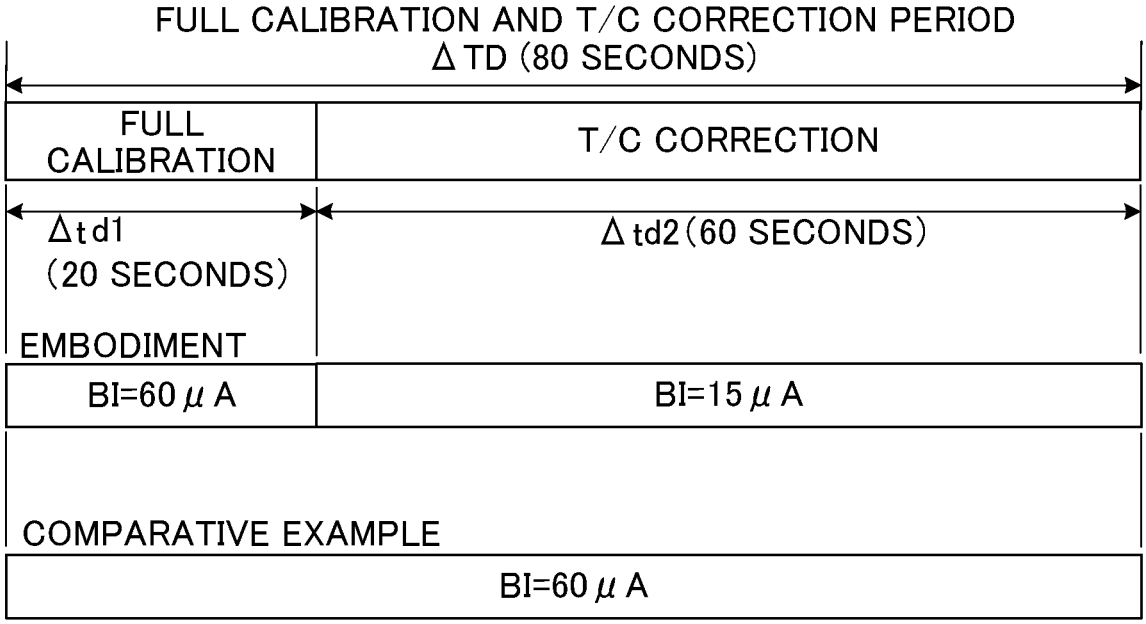
FIG. 9 is a diagram illustrating transition of a bias applied between the intermediate transfer belt and fur brush roller in this embodiment and a bias of the comparative example during a full calibration and T/C correction period.

Thus, as illustrated in FIG. 9, assuming that, in the full calibration and T/C correction period ΔTD, a time zone for the full calibration is a time zone Δtd1 and a time zone for the T/C correction is a time zone Δtd2, the bias BI applied between the intermediate transfer belt 5 and the fur brush roller 19 is set at as large as 60 μA as the first value only in the full calibration time zone Δtd1 and the bias BI is set at as small as 15 μA as the second value in the T/C correction time zone. That is, the full calibration time zone Δtd1 is a time zone in which the residual toners are on the intermediate transfer belt 5. Each of the full calibration time zone Δtd1 and the T/C correction time zone Δtd2 is a fixed preset time zone.

In this case, the controller 41 executes the full calibration and the T/C correction, counts time which has passed from a time point at which the full calibration time zone Δtd1 has started, and at the same time, controls the bias power source BD in the bias application device 37 to, based on the aforementioned passage time, set the bias BI, applied between the intermediate transfer belt 5 and the fur brush roller 19, at as large as 60 μA in the full calibration time zone Δtd1 and set the bias BI at as small as 15 μA in the T/C correction time zone Δtd2.

Consequently, shortening the time zone in which the bias BI is set at 60 μA in the full calibration and T/C correction period ΔTD makes it possible to favorably remove the residual toners on the intermediate transfer belt 5 while suppressing the deviation of the intermediate transfer belt 5. Moreover, lengthening the time zone in which the bias BI is set at 15 μA more suppresses the component degradation.

On the contrary, the bias BI is set at 60 μA throughout the full calibration and T/C correction period in the comparative example as illustrated in FIG. 9, so that the deviation of the intermediate transfer belt 5 occurs even though the residual toners on the intermediate transfer belt 5 can be favorably removed.

FIG. 10 is a table illustrating application amounts and application time of the bias BI applied between the intermediate transfer belt 5 and the fur brush roller 19 in this embodiment and application amounts and application time of the bias BI in the comparative example for the development calibration, the drum refresh, and the full calibration, respectively, in an organized manner. As is clear from the table illustrated in FIG. 10, compared to the comparative example, the application time of a bias BI of 60 μA, which is a relatively high value, is shorter in this embodiment.

FIG. 11A shows tables illustrating results of results of experiments in which distances corresponding to the deviation of the intermediate transfer belt 5 and whether or not the intermediate transfer belt 5 runs onto an end part of the drive roller 23 or of the tension roller 24 are examined, in a case where three sets of intermediate transfer units 20 having the same structures are prepared and application amounts and application time of the bias BI are set as in this embodiment, and operations of the development refresh, the drum refresh, the development refresh, and the full calibration and T/C correction are each performed once in succession. FIG. 11B shows tables illustrating results of experiments in which distances corresponding to the deviation of the intermediate transfer belt 5 and whether or not the intermediate transfer belt 5 runs onto an end part of the drive roller 23 or of the tension roller 24 are examined, in a case where the application amounts and application time of the bias BI are set as in the comparative example.

As described above, the intermediate transfer belt 5 is stretched over the plurality of rollers including the drive roller 23, the tension roller 24, and the backup roller 25, and moves in the direction orthogonal to the circular rotation direction of the intermediate transfer belt 5 corresponding to the amount of the bias BI applied between the intermediate transfer belt 5 and the fur brush roller 19 of the belt cleaner 18. For the purpose of regulating the movement of the intermediate transfer belt 5 in the aforementioned direction, convex parts (belt movement regulation portions) which radially project are each provided on at least one circumferential surface of the drive roller 23, the tension roller 24, and the backup roller 25 at, for example, a position 10.5 mm away from one end part of the intermediate transfer belt 5 and a position 10.5 mm away from the other end part of the intermediate transfer belt 5, in a belt width direction of the intermediate transfer belt 5 stretched at a regular position.

At this point, as is clear from the tables in FIGS. 11A and 11B, in this embodiment, the distances in which the intermediate transfer belt 5 moves to deviate are short and the intermediate transfer belt 5 does not run onto the aforementioned convex part in this embodiment, compared to the comparative example.

Note that the embodiment above refers to the development calibration, the drum refresh, the development refresh, and the full calibration and the T/C correction as examples, but this disclosure is also application to any other type of calibration or maintenance.

Moreover, the first and second values serving as the bias BI applied between the intermediate transfer belt 5 and the fur brush roller 19 of the belt cleaner 18 are not limited to 60 μA as the first value and 15 μA as the second value, respectively, and can be changed as appropriate under condition that relationship such that the first value is greater than the second value is maintained. Further, different first and second values may be set in accordance with a type of calibration or maintenance.

MODIFIED EXAMPLE 1

In Modified Example 1, the controller 41 determines a time zone in which the toners on the intermediate transfer belt 5 make contact with the fur brush roller 19 and controls the bias power source BD in the bias application device 37 to set the application amount of the bias BI large only in the determined time zone. That is, the specified time zone described above is a time zone included in time zones in which the residual toners are present on the intermediate transfer belt 5 and even limited to a time zone in which the residual toners on the intermediate transfer belt 5 make contact with the fur brush roller 19.

For example, the controller 41 causes an electrostatic latent image indicating a test pattern to be formed on the surface of the photoconductive drum 4, causes the developing part 26 to develop the electrostatic latent image of the test pattern to generate a toner image of the test pattern on the surface of the photoconductive drum 4 and transfer the toner image of this test pattern to the intermediate transfer belt 5 in the full calibration. The controller 41 determines timing at which the toner image of the test pattern is transferred from the photoconductive drum 4 to the intermediate transfer belt 5 through processes of generating and transferring such a toner image of the test pattern, and determines a time zone in which the toner image on the intermediate transfer belt 5 makes contact with the fur brush roller 19 based on timing at which the aforementioned determination has been made, a size of the toner image of the test pattern, a speed of the circular movement of the intermediate transfer belt 5, and a distance over which the intermediate transfer belt 5 has made circular movement from the position of the photoconductive drum 4 to the fur brush roller 19. Then the controller 41 controls the bias power source BD in the bias application device 37 to set the application amount of the bias BI only in the determined time zone.

Moreover, a sensor for detecting the toner image on the intermediate transfer belt 5 may be provided on a side closer to an upstream in the circular movement direction of the intermediate transfer belt 5 than the fur brush roller 19, and the time zone in which the toner image on the intermediate transfer belt 5 makes contact with the fur brush roller 19 may be determined based on detection output of the aforementioned sensor. In this case, the controller 41 determines timing at which the toner image has been detected based on the detection output of the sensor, determines the time zone in which the toner image on the intermediate transfer belt 5 makes contact with the fur brush roller 19 based on the determined timing, a size of the toner image, the speed of the circular movement of the intermediate transfer belt 5, and the distance over which the intermediate transfer belt 5 has made circular movement from the position of the sensor to the fur brush roller 19, and controls the bias power source BD in the bias application device 37 to set the application amount of the bias BI large only in the determined time zone.

MODIFIED EXAMPLE 2

In Modified Example 2, the controller 41 controls the bias power source BD in the bias application device 37 to set a larger value corresponding to the application amount of the bias BI with an increase in the concentration of the residual toner on the intermediate transfer belt 5 only in the specified time zone in which the residual toner is present on the intermediate transfer belt 5.

For example, a toner image of a test pattern is generated on the surface of the photoconductive drum 4 and the toner image of the test pattern is transferred to the intermediate transfer belt 5 and the concentration of the toner image of the test pattern on the intermediate transfer belt 5 is detected by a sensor (not illustrated) in the full calibration. The controller 41 controls the bias power source BD in the bias application device 37 to set a larger value corresponding to the application amount of the bias BI with an increase in the detected concentration.

Moreover, in a case where the concentration of the toner on the intermediate transfer belt 5 can be determined based on, for example, a bias applied between the development roller and the supply roller in the developing part 26, the controller 41 may control the bias power source BD in the bias application device 37 to set a larger value corresponding to the application amount of the bias BI with an increase in the determined concentration only in the specified time zone in which the residual toner is present on the intermediate transfer belt 5.

Moreover, the embodiment described above refers to an image forming apparatus (color multifunction peripheral) as one embodiment of the image forming apparatus according to this disclosure, but this forms only one example and an electronic apparatus, for example, any other image forming apparatus such as a printer, a copier or a facsimile device may be used.

Further, the configuration and processing described with reference to FIGS. 1 to 11B form only one embodiment of this disclosure and there is no intention to limit the present invention to the aforementioned configuration and processing.

While the present disclosure has been described in detail with reference to the embodiments thereof, it would be apparent to those skilled in the art the various changes and modifications may be made therein within the scope defined by the appended claims.

What is claimed is:

1. An image forming apparatus comprising:

an intermediate transfer belt of an endless type being stretched over a plurality of rollers and circularly moved, the intermediate transfer belt carrying a toner image to be transferred to recording paper;

an image forming device forming the toner image and transferring the toner image to the intermediate transfer belt a brush roller making contact with the intermediate transfer belt and removing a charged residual toner carried on the intermediate transfer belt a bias application device applying, between the intermediate transfer belt and the brush roller, a bias for shifting the charged residual toner from the intermediate transfer belt to the brush roller; and a control device including a processor and, as a result of executing a control program by the processor, functioning as a controller controlling, in a period in which calibration or maintenance is executed, the bias application device to set an application amount of the bias at a predefined first value only in a specified time zone in which the residual toner is present on the intermediate transfer belt and to set the application amount of the bias at a predefined second value smaller than the first value in time zones other than the specified time zone, wherein in the period in which the calibration for adjusting a bias of a developing part included in the image forming device is performed, the controller controls the bias application device to set the application amount of the bias at the first value only in the specified time zone in which the residual toner is present on the intermediate transfer belt and to set the application amount of the bias at the second value in the time zones other than the specified time zone, the period in which the calibration is performed includes: a discharge adjustment time zone serving as a time zone in which the bias is adjusted to such an extent that does not cause discharge; a toner discharge time zone serving as a time zone in which the toner image is formed and transferred to the intermediate transfer belt; and an aging time zone serving as a time zone for stabilizing operation of the developing part, and the specified time zone corresponds to the aging time zone and the time zones other than the specified time zone correspond to the discharge adjustment time zone and the toner discharge time zone.

2. The image forming apparatus according to claim 1, wherein the controller provides the specified time zone in which the residual toner is present on the intermediate transfer belt as a time zone in which the residual toner on the intermediate transfer belt makes contact with the brush roller.

3. The image forming apparatus according to claim 1, wherein the controller provides the specified time zone as a time zone in which the residual toner is present on the intermediate transfer belt and sets the first value at a larger value with an increase in concentration of the residual toner.

4. An image forming apparatus comprising:

an intermediate transfer belt of an endless type being stretched over a plurality of rollers and circularly moved, the intermediate transfer belt carrying a toner image to be transferred to recording paper;

an image forming device forming the toner image and transferring the toner image to the intermediate transfer belt;

a brush roller making contact with the intermediate transfer belt and removing a charged residual toner carried on the intermediate transfer belt;

a bias application device applying, between the intermediate transfer belt and the brush roller, a bias for shifting the charged residual toner from the intermediate transfer belt to the brush roller; and a control device including a processor and, as a result of executing a control program by the processor, functioning as a controller controlling, in a period in which calibration or maintenance is executed, the bias application device to set an application amount of the bias at a predefined first value only in a specified time zone in which the residual toner is present on the intermediate transfer belt and to set the application amount of the bias at a predefined second value smaller than the first value in time zones other than the specified time zone, wherein in the period of the maintenance in which a surface of an image carrier included in the image forming device is refreshed, the controller controls the bias application device to set the application amount of the bias at the first value only in the specified time zone in which the residual toner is present on the intermediate transfer belt and to set the application amount of the bias at the second value in the time zones other than the specified time zone, the period of the maintenance includes: a time zone formed by repeating a set of a charge aging time zone and a toner discharge time zone a predefined number of times where the charge aging time zone serves as a time zone in which the image carrier is charged and the toner discharge time zone serves as a time zone in which the toner is transferred from the image carrier to the intermediate transfer belt; and a final charge aging time zone, and the specified time zone corresponds to the final charge aging time zone and the time zones other than the specified time zone correspond to the repeated time zones.

5. An image forming apparatus comprising:

an intermediate transfer belt of an endless type being stretched over a plurality of rollers and circularly moved, the intermediate transfer belt carrying a toner image to be transferred to recording paper;

an image forming device forming the toner image and transferring the toner image to the intermediate transfer belt;

a brush roller making contact with the intermediate transfer belt and removing a charged residual toner carried on the intermediate transfer belt;

a bias application device applying, between the intermediate transfer belt and the brush roller, a bias for shifting the charged residual toner from the intermediate transfer belt to the brush roller; and a control device including a processor and, as a result of executing a control program by the processor, functioning as a controller controlling, in a period in which calibration or maintenance is executed, the bias application device to set an application amount of the bias at a predefined first value only in a specified time zone in which the residual toner is present on the intermediate transfer belt and to set the application amount of the bias at a predefined second value smaller than the first value in time zones other than the specified time zone, wherein in the period of the maintenance in which a degraded toner in a developing part included in the image forming device is discharged, the controller controls the bias application device to set the application amount of the bias at the first value only in the specified time zone in which the residual toner is present on the intermediate transfer belt and to set the application amount of the bias at the second value in the time zones other than the specified time zone, the period of the maintenance includes: a time zone formed by repeating a set of a development aging time zone and a toner discharge time zone a predefined number of times where the development aging time zone serves as a time zone in which aging of the developing part is performed and the toner discharge time zone serves as a time zone in which the toner is transferred from the image carrier to the intermediate transfer belt; and a final development aging time zone, and the specified time zone corresponds to the final development aging time zone and the time zones other than the specified time zone corresponding to the repeated time zones.

* * * * *